United States Patent [19]

Hara

[11] Patent Number: 4,611,482

[45] Date of Patent: Sep. 16, 1986

[54] CLOSED DIE FORGING APPARATUS

[75] Inventor: Hirofumi Hara, Komatsu, Japan

[73] Assignee: Kabushiki Kaisha Komatsu Seisakusho, Tokyo, Japan

[21] Appl. No.: 640,271

[22] Filed: Aug. 13, 1984

[30] Foreign Application Priority Data

Aug. 2, 1983 [JP] Japan ..... 58-124466
Aug. 2, 1983 [JP] Japan ..... 58-124467

[51] Int. Cl.[4] ..... B21D 22/00

[52] U.S. Cl. ..... 72/354; 72/358; 72/453.01

[58] Field of Search ..... 72/352, 354, 358, 453.01, 72/453.05, 453.06

[56] References Cited

U.S. PATENT DOCUMENTS 3,290,919 12/1966 Malinak et al. ..... 72/453.05
3,523,445 8/1970 Pennington ..... 72/453.05
4,470,287 9/1984 Antonov et al. ..... 72/453.05

*Primary Examiner*—Francis S. Husar
*Assistant Examiner*—Jerry Kearns
*Attorney, Agent, or Firm*—Armstrong, Nikaido, Marmelstein & Kubovcik

[57] ABSTRACT

A closed die forging apparatus has a fixed bottom die, and a top die at the bottom end of a piston rod depending from a top die carrier rigidly mounted to the underside of a ram. The top die carrier has defined therein a hollow in which a piston is received for up and down motion relative to the top die carrier, with the piston having the piston rod extending downwardly therefrom. A fluid chamber over the piston communicates with a parallel connection of low pressure and high pressure accumulator systems for successively storing the energy of the fluid in the fluid chamber which is pressurized as the ram decends further after moving the top die into contact with the bottom die. The apparatus may further comprise at least one side punch which is forced into and out of the die cavity by an actuating lever acted upon by another fluid cushioned piston built into the top die carrier. A second fluid chamber over this second piston also communicates with an accumulator which stores the fluid pressure developed as the ram descends further after the side punch has been forced fully into the closed die cavity for forging the metal confined therein.

8 Claims, 4 Drawing Figures

58
48
38
36
56
46
40
50
52
44
42
54
92
34
18
22
20
16
34
90
86
88
28
24
94
32
96
26
32
26
60
III
IV
82
66
II
II
72
62
30
60
64
84
80
100
78
70
68
14
98
102
10
74
76
106
108
12
110
104
III
IV
112

CLOSED DIE FORGING APPARATUS

BACKGROUND OF THE INVENTION

This invention relates to a forging apparatus, or apparatus for causing plastic deformation of metals, usually at elevated temperatures, into desired shapes by compressive forces exerted through dies, and more specifically to such a forging apparatus of the closed die variety.

Forging machines in general may be classified into open die and closed die designs depending upon the type of tooling employed and the way the required compressive forces are applied to the workpiece. In an open die machine the workpiece is placed between the two dies and squeezed so that the metal flows to take up the form in the dies. A certain amount of flash is unavoidable as the die faces do not come into contact until forging is completed. Closed dies, on the other hand, have their faces in contact with each other, completely enclosing the workpiece, before forging begins. The plastic deformation of the metal is achieved by means of a punch or punches that enter the die cavity from the top, bottom or side dependant upon the configuration of the desired component. Flash is very much less than with open dies because the die faces are in contact before forging begins.

In conventional closed die forging machines, however, difficulties have been encountered in positively holding the dies closed, during the forging of the confined metal by the punch or punches, with minimal exertion of power on the top die. Additional difficulties manifest themselves in connection with machines incorporating a side punch or punches together with an associated actuating mechanism or mechanisms for horizontally moving the punch or punches into and out of the die cavity. Powered by the same ram as the top die, the side punch actuating mechanisms must be so designed as to cause the side punch to effectively deform the metal with as small power requirement as possible.

SUMMARY OF THE INVENTION

The present invention provides an improved closed die forging machine having a fluid cushioned top die and accumulator means associated therewith, such that the top die can be lowered, and held lowered, with minimum energy requirement for the effective forging of the metal or metal by a punch or punches. The invention also provides an improved actuating mechanism for a side punch, so made that the side punch can be plunged into the die cavity in a well controlled manner and with the exertion of minimum power from the ram driving the top die.

Briefly, the improved closed die forging machine according to the invention includes a top die carrier rigidly mounted to the underside of a ram for up and down motion therewith toward and away from a fixed bottom die. The top die carrier has a hollow formed therein in which a piston is slidably mounted for up and down motion relative to the top die carrier, with the piston defining thereover a fluid chamber to be filled with fluid. The piston has a piston rod slidably extending downwardly through the top die carrier and projecting therefrom to terminate in a top die movable with the piston into and out of contact with the bottom die. Also included are low pressure accumulator means and high pressure accumulator means, both communicating with the fluid chamber in the top die carrier for storing the energy of the fluid pressurized by the piston as the ram descends further after moving the top die into contact with the bottom die. Each of the low pressure and the high pressure accumulator means comprises a pressure tight vessel having a floating piston mounted therein to divide the interior thereof into a pair of opposed fluid chambers, one of which communicates with the fluid chamber in the top die carrier, and an accumulator in communication with the other fluid chamber of the vessel. The low pressure accumulator means absorbs a relatively low pressure rise in the fluid chamber in the top die carrier, and the high pressure accumulator means absorbs a greater pressure rise.

Thus, with the continued descent of the ram following the movement of the top die into contact with the fixed bottom die, the pressure rise in the fluid chamber in the top die carrier is absorbed first by the low pressure accumulator means and then by the high pressure accumulator means. The energy required for holding the dies closed can thus be reduced. The particular construction of the low and high pressure accumulator means set forth above is well calculated to limit the pressure peaks and pressure variations of the fluid in the top die carrier fluid chamber. Further, since both low and high pressure accumulator means directly communicate with the fluid chamber, any delay between their operations can be avoided.

The invention further features an improved actuating mechanism for thrusting a side punch into the cavity of the dies closed as above. The side punch actuating mechanism includes an actuating lever which is operatively linked to the side punch and which is driven from another fluid cushioned piston built into the top die carrier. The side punch can be forced into the die cavity with a very slight displacement of the ram toward its lowermost position.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
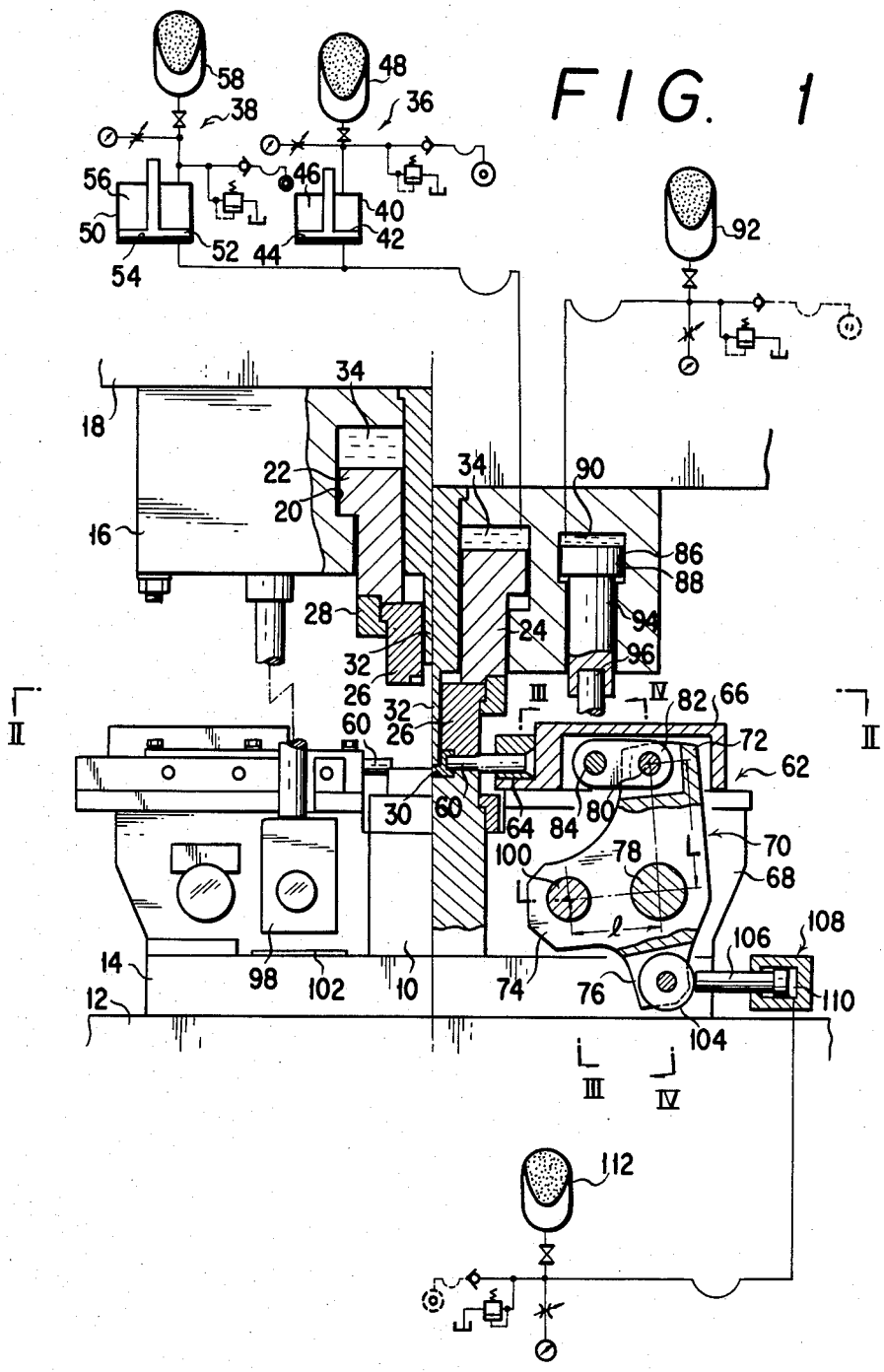
FIG. 1 is a view, partly in elevation and partly in vertical section, of the closed die forging apparatus constructed in accordance with the novel concepts of this invention, the left hand half of the apparatus being shown with the ram raised to open the dies, and the right hand half of the apparatus being shown with the ram lowered to close the dies.

The closed die forging apparatus in accordance with the invention is shown in the drawings as adapted to include a top punch and three side punches by way of example. A consideration of FIG. 1 will make clear the general organization of the representative forging apparatus. It includes a fixed bottom die 10 mounted on a bolster 12 via a baseplate 14.

Over the bottom die 10 a top die carrier 16 is rigidly mounted to the underside of a conventional slide or ram 18 for up and down motion therewith toward and away from the bottom die. The top die carrier 16 has formed therein a hollow 20 in which a piston 22 is received for up and down sliding motion relative to the top die carrier. The piston 22 has a piston rod 24 depending therefrom and slidably extending through the top die carrier 16 to partly project downwardly therefrom. A top die 26 is affixed to this projecting bottom end of the piston rod 24 by means of a retainer ring 28. When the top die 26 is moved into contact with the bottom die 10, as depicted in the right hand half of FIG. 1, the two dies define in combination a cavity 30 of a desired shape into which a workpiece is to be formed. A top punch 32 is secured to the understide of the ram 18 and slidably extends through the piston 22, piston rod 24, and top die 26. Normally held retracted in the top die 26 as shown in the left hand half of FIG. 1, a bottom end portion of the top punch 32 is to plunge into the die cavity 30 as the ram 18 descents further after moving the top die into contact with the bottom die 10, since then the top die is displaced upwardly with the piston 22 relative to the top die carrier 16, as will be more fully discussed hereafter.

Slidably engaged in the hollow 20 in the top die carrier 16 as above, the piston 22 defines thereover a fluid chamber 34 filled with fluid such as, typically, hydraulic oil. This fluid chamber communicates with a parallel connection of a low pressure accumulator system 36 and a high pressure accumulator system 38. The low pressure accumulator system 36 includes a cylinder or pressure tight vessel 40 having a floating piston 42 slidably mounted therein to divide the interior thereof into a pair of opposed fluid chambers 44 and 46. The fluid chamber 44 is in direct communication with the fluid chamber 34 in the top die carrier 16. The other fluid chamber 46 is in direct communication with an accumulator 48.

The high pressure accumulator system 38 is akin in construction to the low pressure accumulator system 36, including another cylinder or pressure tight vessel 50 of greater diameter than the vessel 40 of the low pressure accumulator system. The vessel 50 also has a floating piston 52 slidably mounted therein to divide the interior thereof into a pair of opposed fluid chambers 54 and 56. The fluid chamber 54 is in direct communication with the fluid chamber 34 in the top die carrier 16, and the other fluid chamber 56 is in direct communication with an accumulator 58.

The pressure in the fluid chamber 34 in the top die carrier 16 rises as the ram 18 descends further after moving the top die 26 into contact with the bottom die 10. Both low pressure accumulator system 36 and high pressure accumulator system 38 function to absorb such pressur rise in the fluid chamber 34.

Figure 2:
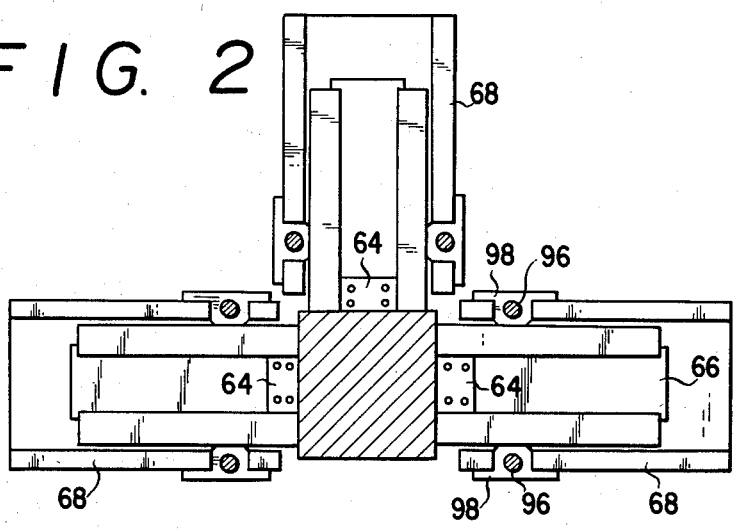
FIG. 2 is a horizontal section through the forging apparatus, taken along the line II—II in FIG. 1 and showing in particular the arrangement of three side punch actuating mechanisms built into the apparatus.

As will be seen from FIGS. 1 and 2, the exemplified forging apparatus is shown to have three side punches 60 movable horizontally into and out of the die cavity 30. Since the three side punches as well as their actuating mechanisms 62 can all be identical, there will be described in detail only one of the side punches, seen on the right hand side in FIG. 1, in conjunction with the actuating mechanism associated therewith, it being understood that the same description applies to the other side punches and to the actuating mechanisms therefor.

Figure 3:
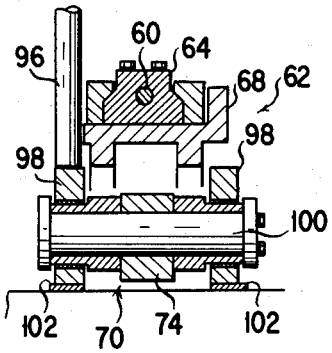
FIG. 3 is a section through the forging apparatus, taken along the line III—III in FIG. 1 and showing one of the three side punch actuating mechanisms.
Figure 4:
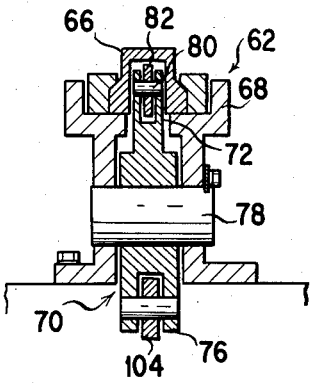
FIG. 4 is also a section through the forging apparatus, taken along the line IV—IV in FIG. 1 and showing the side punch actuating mechanism.

With reference directed also to FIGS. 3 and 4 the representative side punch 60 is supported by a punch holder 64. This punch holder is rigidly mounted on a hollow carriage 66 which in turn is slidably mounted on a hollow support structure 68 and thereby constrained to horizontal reciprocation toward and away from the dies 10 and 26. The support structure 68 is mounted on the baseplate 14 in a fixed relation to the bottom die 10.

The actuating mechanism 62 for the side punch 60 includes an approximately T shaped actuating lever 70 pivotally mounted within the hollow support structure 68. The actuating lever 70 has three arms 72, 74 and 76 and is pivoted on a pin 78 passing the junction of the three arms. The first arm 72 of the actuating lever 70 is pivotally pinned at 80 to one end of a link 82, the other end of which is pivotally pinned at 84 to the carriage 66. It is thus seen that the link 82 serves to translate the bidirectional pivotal motion of the actuating lever 70 into the rectilinear reciprocation of the carriage 66 and, consequently, of the side punch 60. The side punch 60 enters the die cavity 30 upon counterclockwise turn, as viewed in FIG. 1, of the actuating lever 70 and is withdrawn therefrom upon clockwise turn of the actuating lever.

In order to cause the counterclockwise turn of the actuating lever 70, a second piston 86 is slidably fitted in a second hollow 88 defined in the top die carrier 16. The second piston 86 is movable up and down relative to the top die carrier 16 and defines thereover a second pressure tight fluid chamber 90 which is filled with hydraulic oil or like fluid and which communicates with an accumulator 92. Directed downwardly from the second piston 86, a second piston rod 94 slidably extends through the top die carrier 16 and projects downwardly therefrom. The projecting end of the second piston rod 94 has a pair of thrust pins 96 rigidly attached thereto and depending therefrom in parallel spaced relationship to each other, with each thrust pin disposed on either side of the support structure 68.

Disposed just under the pair of thrust pins 96 are a pair of abutments 98 of rectangular shape, seen in both FIGS. 1 and 3, which are mounted on the opposite ends of a spindle 100 passing horizontally through the distal end of the second arm. Thus as the thrust pins 96 descend with the ram 18, the actuating lever 70 is pivoted counterclockwise to cause the side punch 60 to thrust into the die cavity 30 via the link 82 and carriage 66. A pair of stop plates 102 are placed on the baseplate 23, on both sides of the support structure 68, so as to underlie the respective abutments 98 on the actuating lever arm 74. To be butted on by the abutments 98, the stop plates 102 function to positively limit the counterclockwise turn of the actuating lever 70 upon descent of the ram 18. The thickness or height of the stop plates 102 may be varied as desired to correspondingly change the extent to which the actuating lever 70 is allowed to turn counterclockwise and, therefore, the extent to which the side punch 60 is thrusted into the die cavity 30.

With reference to both FIGS. 1 and 4 the third arm 76 of the actuating lever 70 is bifurcated to rotatably support a roll 104 therebetween. Held against this roll 104 is a piston rod 106 of a biasing cylinder 108. The biasing cylinder 108 has a head end chamber 110 in communication with an accumulator 112. Normally the piston rod 106 of the biasing cylinder is held extended to hold the actuating lever 70 pivoted fully in a clockwise direction and hence to hold the side punch 60 withdrawn from the die cavity 30.

Operation

A workpiece to be forged is first placed in the impression in the bottom die 10. As the ram 18 is lowered, the top die 26 descends therewith into contact with the bottom die 10 thereby confining the workpiece in the closed die cavity 30. Upon continued descent of the ram 18 the first piston 22 carrying the top die 26 travels upwardly relative to the top die carrier 16 against the fluid pressure in the first fluid chamber 34. This fluid pressure is effective to hold the top die 26 firmly closed against the bottom die 10.

As the fluid pressure in the first fluid chamber 34 rises with the continued descent of the ram 18, the pressure rise is first absorbed by the low pressure accumulator system 36 and then by the high pressure accumulator system 38. These accumulator systems comprise as aforesaid the cylinders or pressure tight vessels 40 and 50, and the accumulators 48 and 58 in communication with the fluid chambers 46 and 56 of the vessels 40 and 50, respectively. Consequently the fluid pressure in the first fluid chamber 34 in the top die carrier 16 first acts on the floating pistons 42 and 52 within the vessels 40 and 50 and is then absorbed by the accumulators 48 and 58. This manner of pressure absorption is effective to reduce pressure peaks and pressure variations in the first fluid chamber 34.

With the continued descent of the ram 18 after the movement of the top die 26 into contact with the bottom die 10, the top punch 32 rigidly attached to the ram is forced into the closed die cavity 30 to cause deformation of the workpiece confined therein.

The pistons 86 associated with the three side punches 60 also descend with the ram 18. The thrust pins 96 depending from the piston rods 94 act on the abutments 98 on the second arms 74 of the actuating levers 70 thereby causing the same to pivot in a counterclockwise direction, as viewed in FIG. 1, against the effect of the biasing cylinders 108 until the abutments hit the stop plates 102. The link 82 translates this counterclockwise turn of the actuating lever 70 into the linear leftward travel of the carriage 66. Thus the side punches 60 plunge into the closed die cavity 30 and deforms the metal into the required shape in coaction with the top punch 32. The reactive forces exerted on the side punches 60 by the metal are borne by the fluid in the fluid chambers 90 in the top die carrier 16. The stroke of the side punches 60 may be readily varied as required by altering the height of the stop plates 102.

The descent of the ram 18 after the actuating lever 70 has been turned fully in a counterclockwise direction as above results in the pressurization of the fluid in the fluid chambers 90 in the top die carrier 16. The pressure rise in the fluid chambers 90 is absorbed by the accumulator 92. The side punches 60 remain inserted in the die cavity 30 under fluid pressure exerted through the carriage 66 during the ram descent over the additional distance.

When the ram 18 is raised upon completion of forging, the top punch 32 is first withdrawn from the die cavity 30. Then the top die 26 travels upwardly with the piston 22, out of contact with the bottom die 10, causing a pressure drop in the fluid chamber 34 in the top die carrier 16. Thereupon the presurized fluid that has been stored in the two accumulator systems 36 and 38 returns to the fluid chamber 34. The thrust pins 96 also ascend with the associated pistons 86. Freed from the upward forces from the actuating levers 70, the pictons 86 allow the fluid to return from the accumulator 92 to the fluid chambers 90. Further, when the thrust pins 96 move out of contact with the abutments 98, the accumulator 112 returns the fluid to the biasing cylinders 108 thereby causing the same to turn the actuating levers 70 in a clockwise direction, with the consequent withdrawal of the side punches 60 from the die cavity 30. The foregoing cycle of operation is repeated to forge the successive workpieces.

In the above forging operation by the improved apparatus of this invention, the position where each side punch 60 is stopped on its forward stroke depends upon the height of the stop plates 102. Accordingly, if the stroke of the ram 18 is constant, the height of the stop plates 102 determines the extent to which the pistons 86 associated with the side punches 60 are displaced upwardly relative to the top die carrier 16 against the fluid pressure in the fluid chambers 90. It is thus seen that the period of time during which the side punches 60 are held at a standstill in the die cavity 30 is readily variable as required by changing the height of the stop plates 102.

With reference to FIG. 1 the capital L indicates the distance between the axis of each actuating lever 30 and the center of the pin 80 connecting the first arm 72 of the actuating lever to the link 82. The small letter l denotes the distance between the axis of each actuating lever 30 and the center of the spindle 100 connecting the second arm 74 of the actuating lever to the pair of abutments 98. Optimumly, for reducing the power requirement of each side punche 60, the distance L should be greater than the distance l. With the relative distances L and l so determined, each actuating lever 30 will be required to turn a correspondingly smaller angle for a given stroke of the associated side punch 60. Consequently the ram 18 will be required to power the actuating lever while traveling a small distance toward the end of its downward stroke.

Although the forging apparatus in accordance with the present invention has been shown and described in terms of a specific example thereof having a top punch and three side punches, it is understood that the number and arrangement of the punches are merely illustrative and not to impose limitations upon the invention because they are subject to change depending upon the forging to be made. Additional modifications or alterations of the illustrated embodiment will readily occur to the specialists without departing from the scope of the invention.

What is claimed is:

1. In a closed die forging apparatus, in combination:

(a) a fixed bottom die;

(b) a ram disposed above the bottom die for up and down motion relative to the same;

(c) a top die carrier rigidly mounted to the underside of the ram and having a hollow defined therein;

(d) a piston slidably engaged in the hollow in the top die carrier for up and down motion relative to the top die carrier and pressure tightly defining thereover a fluid chamber to be filled with fluid;

(e) a piston rod directed downwardly from the piston and slidably extending through the top die carrier;

(f) a top die formed at the bottom end of the piston rod for movement therewith into and out of contact with the bottom die with the up and down motion of the ram, the top and bottom dies defining in combination a die cavity in which a workpiece is to be forged into a desired shape;

(g) low pressure accumulator means for storing the energy of the fluid in the fluid chamber in the top die carrier as the fluid is pressurized by the piston to a comparatively small extent upon continued descent of the ram after the top die has been thereby moved into contact with the bottom die, the low pressure accumulator means comprising a first pressure tight vessel having a floating piston mounted therein to divide the interior thereof into a pair of opposed fluid chambers, one of the fluid chambers of the first vessel being in communication with the fluid chamber in the top die carrier, and a first accumulator in communication with the other of the fluid chambers of the first vessel; and (h) high pressure accumulator means for storing the energy of the fluid in the fluid chamber in the top die carrier as the fluid is pressurized to a greater extent upon continued descent of the ram after the top die has been thereby moved into contact with the bottom die, the high pressure accumulator means comprising a second pressure tight vessel having a floating piston mounted therein to divide the interior thereof into a pair of opposed fluid chambers, one of the fluid chambers of the second vessel being in communication with the fluid chamber in the top die carrier, and a second accumulator in communication with the fluid chambers of the second vessel.

2. The closed die forging apparatus of claim 1 further comprising a top punch ridigly mounted to the underside of the ram and slidably extending through the piston and the piston rod and the top die, the punch entering the die cavity upon continued descent of the ram after the top die has been closed against the bottom die.

3. The closed die forging apparatus of claim 1 further comprising:

(a) a side punch movable horizontally into and out of the die cavity defined by the top and bottom dies;

(b) an actuating lever mounted to a stationary part for pivotal motion about a horizontal axis;

(c) means for translating the pivotal motion of the actuating lever into the linear travel of the side punch into and out of the die cavity;

(d) biasing means for normally holding the side punch out of the die cavity;

(e) there being a second hollow defined in the top die carrier;

(f) a second piston slidably mounted in the second hollow in the top die carrier for up and down motion relative to the top die carrier and pressure tightly defining thereover a second fluid chamber to be filled with fluid;

(g) a second piston rod directed downwardly from the second piston and slidably extending through the top die carrier to project downwardly therefrom, the projecting end of the second piston rod being adapted to act, upon descent of the second piston with the ram, on the actuating lever for pivoting the same in a predetermined direction to cause the side punch to be forced into the die cavity against the effect of the biasing means;

(h) stop means for limiting the pivotal motion of the actuating lever in the predetermined direction; and (i) third accumulator means communicating with the second fluid chamber in the top die carrier for storing the energy of the fluid pressurized by the second piston upon continued descent of the ram after the pivotal motion of the actuating lever in the predetermined direction has been arrested by the stop means.

4. The closed die forging apparatus of claim 3 wherein the actuating lever is substantially T shaped, comprising:

(a) a first arm coupled to the side punch via the translating means;

(b) a second arm adapted to be acted upon by the second piston rod; and (c) a third arm adapted to be acted upon by the biasing means;

(d) the actuating lever being pivoted at the junction of the first, second and third arms.

5. The closed die forging apparatus of claim 4 wherein the second arm of the actuating lever is movable into and out of abutting contact with the stop means, the stop means providing for a change in the angular position where the pivotal motion of the actuating lever in the predetermined direction is arrested.

6. The closed die forging apparatus of claim 4 wherein the biasing means comprises a fluid actuated cylinder.

7. The closed die forging apparatus of claim 6 further comprising fourth accumulator means communicating with the fluid actuated cylinder of the biasing means for storing the energy of the fluid in the cylinder pressurized upon pivotal motion of the actuating lever in the predetermined direction.

8. The closed die forging apparatus of claim 4 wherein the first arm of the actuating lever is longer than the second arm thereof whereby the actuating lever is required to turn a reduced angle for a given stroke of the side punch.

* * * * *